United States Patent [19]

Bodine

[11] 4,256,190

[45] Mar. 17, 1981

[54] SONICALLY ASSISTED LUBRICATION OF JOURNAL BEARINGS

[76] Inventor: Albert G. Bodine, 7877 Woodley Ave., Van Nuys, Calif. 91406

[21] Appl. No.: 27,934

[22] Filed: Apr. 6, 1979

[51] Int. Cl.[3] ..... E21B 10/22

[52] U.S. Cl. ..... 175/56; 175/227

[58] Field of Search ..... 175/56, 227, 228, 229, 175/371, 372; 308/8 L

[56] References Cited

U.S. PATENT DOCUMENTS

| | | | |
|---|---|---|---|
| 3,096,833 | 7/1963 | Bodine | 175/56 |
| 3,244,459 | 4/1966 | Ortloff | 308/8.2 |
| 3,746,405 | 7/1973 | Welton | 308/8.2 |
| 3,761,145 | 9/1973 | Schumacher, Jr. | 175/371 |
| 3,890,018 | 6/1975 | Clamon | 308/8.2 |

*Primary Examiner*—William F. Pate, III

*Attorney, Agent, or Firm*—Edward A. Sokolski

[57] ABSTRACT

A roller cone drill bit which is supported for rotation on a bearing pin by means of a journal bearing is sonically driven, preferably by means of a resonant vibration system formed in an elastic column which receives vibratory energy from an orbiting mass oscillator. The roller cone also is mechanically rotated by virtue of conventional rotary motion of the drilling string. Enough clearance is provided at the journal bearing between the bearing pin and the roller cone to provide a thick film of lubricating oil at this bearing. The energy provided at the bearing from the resonant vibration system, in view of its periodically reversing high G acceleration short time duration force pulses, effectively operates to increase the gap in the lower portions of the journal bearing between the bearing pin and the roller cone during the "upward" acceleration of the sonic vibration cycle causing the lubricant to run from the upper portions of the bearing down to the lower portions thereof where the lubricant builds up so that when the "downward" portion of the cycle occurs there will be an ample oil film in these lower portions to provide the needed lubrication.

4 Claims, 3 Drawing Figures

SONICALLY ASSISTED LUBRICATION OF JOURNAL BEARINGS

This invention relates to sonic resonant drilling and driving systems, and more particularly to such a system having a drilling bit which is rotatably supported on a lubricated journal bearing.

Roller cone drilling bits, such as are commercially available from the Hughes Tool Company, Reed Tool Company and Smith Tool Company, have come into widespread use for oil well drilling. This type of bit has been generally utilizing either roller or ball bearings for rotatably supporting the cutter heads or journal type bearings. It has been found in the case of journal bearing type bits operating in conjunction with sonic drive systems, such a sonic system being described in my U.S. Pat. No. 3,096,833, that the high level longitudinal cyclic drilling forces provided in such a sonic system can be handled far better than in the case of ball or roller bearings. This, it has been found, is due to the fact that the vibratory reversing forces, which are superimposed on the steady down drive of the drill, operate to give the lubricant an opportunity to build up a thick oil film on the working side of the journal bearing which is available during the downward portion of the vibratory cycle and is not extruded out of the bearings as often was the case in prior art systems. A particular optimum dimensional relationship between the bearing pin and the inner diameter of the roller cone provides optimum annular spacing therebetween for the lubricant, for most effective lubrication.

It is therefore an object of this invention to improve the operation of journal bearings for a drilling bit.

It is a further object of this invention to lessen the wear and increase the life of a journal bearing for a drilling bit.

Other objects of the invention will become apparent as the description proceeds in connection with the accompanying drawings of which:

Figure 1:
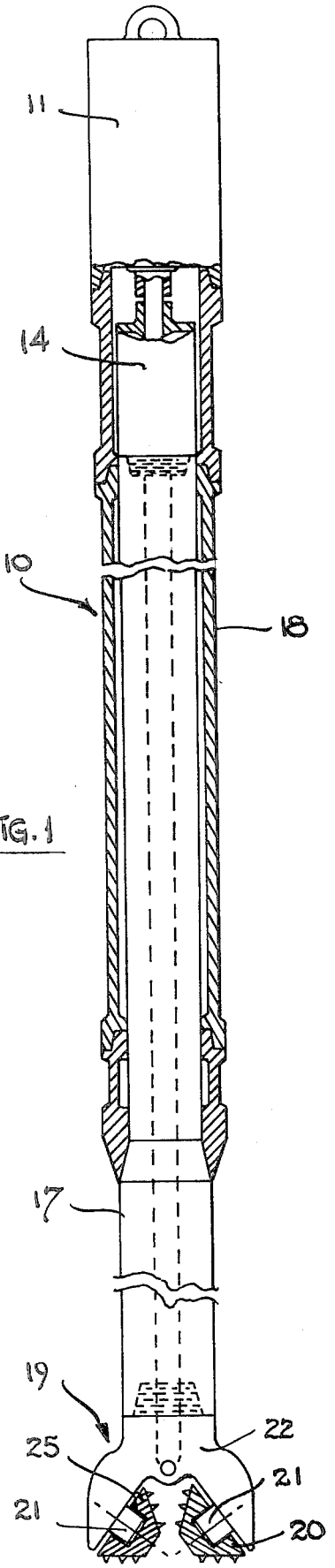
FIG. 1 is an elevational view in cross section illustrating the device of the invention.

Referring now to FIG. 1, a drilling system incorporating the device of the invention is illustrated. This drilling system, except for the bit portion 19, is essentially as described in my U.S. Pat. No. 3,096,833, issued July 9, 1963. This drilling system may include an electric motor 11 which drives oscillator 14 in a manner such as to develop vibratory energy in a longitudinal vibratory mode. This energy is transferred to elastic column 17 which may be made of steel, such as to cause longitudinal resonant vibration thereof, the details of such operation being fully described in my aforementioned patent. The drill assembly 10 is rotated by a conventional rotary stem system (not shown) as is well known in the art. Jacket 18 is used to control lateral vibration of the column 17 and to provide isolation of longitudinal vibration. Attached to the bottom end of column 17 is drilling bit 19 which includes a housing portion 22 having bearing pins 21 which extend angularly inwardly and downwardly therefrom. Bearing pins 21 extend at an angle having a substantial vectorial component normal to the longitudinal axis of the column. Rotatably supported on bearing pins 21 are roller cone cutters 20, such support being provided by sealed lubricated journal bearings 25 formed between the pins and the inner walls of the roller cones.

In typical operation, longitudinal resonant vibratory energy is provided from the oscillator at a frequency of 100–200 hertz to column 17 with the drilling unit 10 being rotated at a rate of about 50 rpm.

Figure 2:
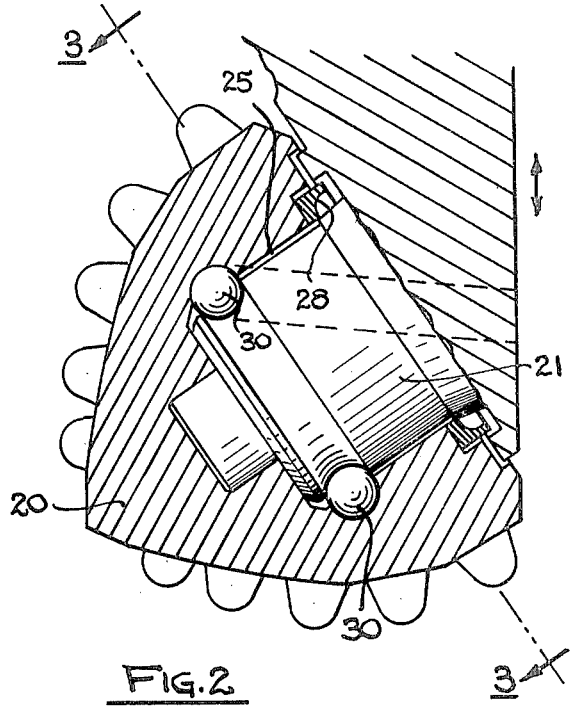
FIG. 2 is a cross-sectional view in elevation illustrating an embodiment of the roller cone and its associated journal bearing of the invention.
Figure 3:
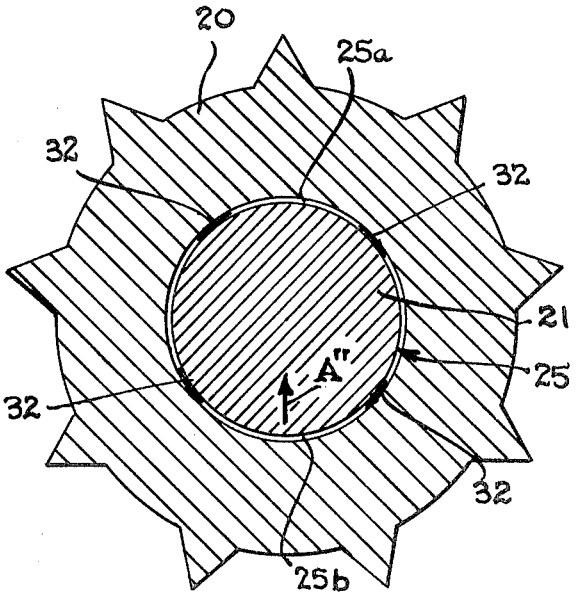
FIG. 3 is a cross-sectional view taken along the plane indicated by 3—3 in FIG. 2.

Referring now to FIGS. 2 and 3, the details of the roller cones and their associated journal bearings are illustrated. Roller cone cutting head 20 is rotatably supported on pin member 21 by means of journal bearing 25 formed by a thick oil film between the opposing surfaces of the pin and the inner wall of the roller cone. The roller cone is retained on the bearing by means of ball members 30. An O-ring seal 28 is provided to seal off bearing 25 so that the oil film therein can be retained. As can best be seen in FIG. 3, there is a gap at the journal 25 with the lubricating oil being contained within this gap and free to rotate therearound. It has been found that this gap can be designed to an optimum diametrical dimension, this being no less than 0.001 inches per inch of pin diameter as measured at the journal bearing. Thus, for a pin diameter at the journal of 3 inches, the width of the radial gap at the bearing journal should be no less than 0.0015 inches.

Referring now to FIG. 3, the journal bearing of the invention operates in the following manner. When the resonant column has passed the midpoint of the downward portion of its vibration cycle, an upward acceleration, as indicated by arrow "A", is applied to the bearing pin 21. This causes the pin to move upwardly relative to the roller cone, which tends to continue to move downwardly, thereby lessening the gap at the upper portion **25*a* of the journal bearing and increasing the gap at the lower portion 25*b* of this bearing. This has the effect of forcing oil from the upper portion 25*a* of the bearing to the lower portion 25*b* thereof, as indicated by arrows 32**. In this manner, the lubricant is built up in the lower portion of the bearing so that it is available during the peak downward portion of the cycle when it is most needed in this location. A similar buildup of oil on the upper portions of the bearing occurs during the upward vibratory portions of the cycle. This latter buildup is not nearly as important as on the downward cycle in view of the fact that the net down load is always substantially greater due to the operation of gravity on the weight of the drill string. In this manner, a thick oil film is always available on the working side of the bearing when needed, such that when the short duration additional loading provided by the vibratory cycle adds to the continual downweight of drilling, the oil film will not extrude out of the bearing. Further, a good cushioning film of oil is automatically supplied to the lower portions of the bearing when it is most needed on the peak of the downcycle of the vibratory stroke, thus assuring proper cushioning for the bearing.

While the invention has been described and illustrated in detail, it is to be clearly understood that this is intended by way of illustration and example only and is not to be taken by way of limitation, the spirit and scope of this invention being limited only by the terms of the following claims.

I claim:

1. A sonic drill for drilling through a material forming a load for the drill including in combination an elastic drilling column, an orbiting mass oscillator coupled to said column, means for rotatably driving said oscillator at a frequency such as to cause resonant longitudinal vibration of said column, a drilling bit attached to the bottom of said column and receiving the output of said resonant column, said bit including a cutter member and a bearing pin member on which said cutter is rotatably supported, a journal bearing being formed between said members, said pin member extending at an angle which is normal to the longitudinal axis of said column, and a fluid lubricant, there being a gap between said members at said bearing in which said lubricant is retained, such that the longitudinal vibration causes the lower portions of said gap to increase while the upper portions of the gap decrease with the upward sonic acceleration of the vibration cycle of the column causing the lubricant to build up in the lower gap portion so that it is available at this location during the downward portion of the sonic cycle.

2. The drill of claim 1 wherein said cutter member is a roller cone.

3. The drill of claim 1 and further including a jacket member for minimizing lateral vibration of the column.

4. The drill of claims 1 or 2 wherein the gap between the members in said diametric gap is at least 0.001 inches for each inch in the diameter of said pin member diameter.

* * * * *